US006641716B1

(12) United States Patent
Greaney et al.

(10) Patent No.: US 6,641,716 B1
(45) **Date of Patent: *Nov. 4, 2003**

(54) METHOD FOR ISOLATING ENRICHED SOURCE OF CONDUCTING POLYMERS PRECURSORS USING MONOHYDROXYL ALCOHOL TREATING AGENT

(75) Inventors: Mark Alan Greaney, Upper Black Eddy, PA (US); John N. Begasse, Livingston, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/551,658

(22) Filed: Apr. 18, 2000

(51) Int. Cl.[7] ..... C10G 17/00; C10C 1/18
(52) U.S. Cl. ..... 208/254 R; 208/45
(58) Field of Search ..... 208/254 R, 45

(56) References Cited

U.S. PATENT DOCUMENTS

| | | | | |
|---|---|---|---|---|
| 2,352,236 A | * | 6/1944 | Thomas | 196/36 |
| 2,514,997 A | | 7/1950 | Floyd | 196/24 |
| 2,634,230 A | | 4/1953 | Arnold et al. | 196/24 |
| 2,664,385 A | | 12/1953 | Wolf et al. | 196/31 |
| 2,741,578 A | | 4/1956 | McKinnis | 196/14.4 |
| 2,792,332 A | | 5/1957 | Hutchings | 196/14.17 |
| 2,848,375 A | | 8/1958 | Gatsis | 196/39 |
| 2,902,428 A | | 9/1959 | Kimberlin, Jr. et al. | 208/87 |
| 2,956,946 A | | 10/1960 | King et al. | 208/263 |
| 3,824,766 A | | 7/1974 | Valentine et al. | 55/48 |
| 3,837,143 A | | 9/1974 | Sutherland et al. | 55/32 |
| 3,915,674 A | | 10/1975 | Smith | 55/48 |
| 3,957,625 A | | 5/1976 | Orkin | 208/211 |
| 4,242,108 A | | 12/1980 | Nicholas et al. | 55/40 |
| 4,498,980 A | | 2/1985 | Forte | 208/321 |
| 4,781,820 A | | 11/1988 | Forte | 208/333 |
| 4,960,507 A | | 10/1990 | Evans et al. | 208/254 R |
| 4,960,508 A | * | 10/1990 | Evans | 208/254 R |
| 4,985,139 A | | 1/1991 | Madgavkar | 208/321 |
| 5,002,655 A | * | 3/1991 | Ukegawa et al. | 208/254 R |
| 5,290,427 A | | 3/1994 | Fletcher et al. | 208/89 |
| 5,298,150 A | | 3/1994 | Fletcher et al. | 208/89 |
| 5,675,043 A | * | 10/1997 | Eppig et al. | 568/697 |
| 6,007,705 A | | 12/1999 | Greaney et al. | 208/251 |

FOREIGN PATENT DOCUMENTS

| | | | |
|---|---|---|---|
| WO | WO00/71494 A1 | 11/2000 | C07C/7/10 |

OTHER PUBLICATIONS

Abstract—Derwent Publications—AN 1997–481174, XP002180257, CN 1 121 103 A(Bejing Inst Fuel Gas & Coal Chem Eng), Apr. 24, 1996.

Ullmann's Encyclopedia of Industrial Chemistry, vol. A21, pp. 429–447 (1992).

* cited by examiner

*Primary Examiner*—J. Parsa
(74) *Attorney, Agent, or Firm*—Linda M. Scuorzo

(57) ABSTRACT

An embodiment of the present invention is a method for isolating conducting polymer precursors by contacting a non-basic heterocyclic nitrogen containing hydrocarbon stream having a boiling point of from 232° C. (450° F.) to 566° C. (1050° F.) with an effective amount of a treating agent selected from monohydroxyl alcohols having a density at 25° C. of less than 0.90 g/cm$^3$ and mixtures thereof, at conditions effective to maintain the reactants in a liquid phase to produce a first stream enriched in non-basic heterocyclic nitrogen containing hydrocarbon compounds and a second treated stream having a decreased non-basic heterocyclic nitrogen content. Optionally, an effective amount of mineral acid may be added to the hydrocarbon stream to enhance the process.

7 Claims, No Drawings

METHOD FOR ISOLATING ENRICHED SOURCE OF CONDUCTING POLYMERS PRECURSORS USING MONOHYDROXYL ALCOHOL TREATING AGENT

FIELD OF THE INVENTION

The present invention relates to a method for isolating an enriched source of conducting polymer precursors from heterocyclic nitrogen containing hydrocarbon streams.

BACKGROUND OF THE INVENTION

Conducting polymers such as polypyrrole, polyindole, polycarbazole and other polymeric heterocyclic nitrogen containing compounds are valuable commodities (see "Polymers, Electrically Conducting", by Herbert Naarman, in Ullmann's Encyclopedia of Industrial Chemistry, Vol. A21, VCH Publishers, Inc., 1992, pp. 429–447), the potential uses of which include flexible conductive paths in printed circuit boards, heating films, film keyboards, as electrode materials in rechargeable batteries and as polymer coatings in electrochemical sensor devices. These polymers can be synthesized from suitable monomers or precursors by known processes.

Petroleum streams provide potential sources of such monomers or precursors. However, the concentration of these monomers or precursors is typically very low and they are contaminated with similar boiling point materials, which makes their isolation difficult. These monomers or precursors currently are not valuable as fuel sources, and in fact, act as poisons for catalysts, so their removal from the petroleum streams would provide a dual benefit of removing catalyst poisons from the petroleum stream while facilitating the recovery of compounds having value for use as chemical products.

Petroleum streams contain a wide variety or organo-nitrogen species. Therefore, efforts to remove some of these species, due to their deleterious effects on catalysts used in petroleum processing have been made. For example, in U.S. Pat. No. 5,675,043 a process is described which removes nitrites from low-boiling petroleum feedstocks for catalytic conversion processes. Therein model nitrile (RCN) containing hydrocarbon streams were treated at lower temperatures, e.g., 16–149° C., (60–300° F.) using solvents meeting a specific formula. The model feeds did not contain heterocyclic nitrogen compounds such as those characteristic of heavy hydrocarbon feeds, e.g., in feeds having a boiling point of 232–566° C. (450° F. to 1050° F.). Additionally, the reference teaches away from the use of higher process temperatures and the reference notes that selection of solvents cannot be easily determined a priori. Actual petroleum streams are complex mixtures of nitrogen containing compounds and other components. Thus one skilled in the art would not be able to extrapolate from the low-boiling nitrile-containing hydrocarbon stream of the reference to treatment of other, higher-boiling streams containing different organo-nitrogen species.

Other patents describe the removal of basic heterocyclic nitrogen species, such as, quinolines from crude oils or fractions by extraction with carboxylic acids (e.g., U.S. Pat. No. 4,985,139 using carboxylic acids; and U.S. Pat. No. 2,848,375 using boric acid and polyhydroxyorganic compounds). In this case, advantage is taken of the basicity of the target molecule to be removed, by reacting it with an acidic extractant. However, the organonitrogen species remaining in the feed after the treatment with acid are believed to be non-basic heterocyclic nitrogen species. The described method is ineffective for their removal. These "non-basic" heterocyclic nitrogen species, e.g., pyrrole, indole, carbazole and their substituted derivatives fall into this class. However, since they are not believed to be as deleterious to catalyst function as are the basic heterocyclic nitrogens, or to have as negative an impact on petroleum product performance, less effort has been directed at their removal.

It would be desirable to develop processes for selectively isolating or recovering these non-basic nitrogen-containing heterocyclic materials useful as precursors to more valuable products. Applicants invention addresses this need.

SUMMARY OF THE INVENTION

An embodiment of the present invention provides for contacting a non-basic heterocyclic nitrogen containing hydrocarbon stream having a boiling point of from 232° C. (450° F.) to 566° C. (1050° F.) with an effective amount of a treating agent selected from monohydroxyl alcohols having a density at 25° C. of less than 0.90 g/cm$^3$ and mixtures thereof, at conditions effective to maintain the reactants in a liquid phase to produce a first stream enriched in non-basic heterocyclic nitrogen containing hydrocarbons and a second treated stream having a decreased non-basic heterocyclic nitrogen content. Optionally, an effective amount of mineral acid may be added in conjunction with the treating agent. Or, optionally the second, treated stream is contacted with an effective amount of the monohydroxyl alcohols and an effective amount of a mineral acid.

The present invention may comprise, consist or consist essentially of the steps recited and may be practiced in the absence of a step or limitation not disclosed as required.

DETAILED DESCRIPTION OF THE PREFERRED EMBODIMENTS

Electropolymerization reactions require the presence of conducting polymers and appropriate monomers to continue chain growth. For example, to produce polypyrroles, polyindoles or polycarbazoles the corresponding precursor (i.e., monomers) are required; pyrroles, indoles and carbazoles, whether substituted or unsubstituted. By substitution is meant that additional noninterfering organic groups such as alkyl, cycloalkyl, or aryl side-chains may also be found on these monomers. This will typically be the case with monomers derived from petroleum sources.

The preferred embodiment of the present invention provides for a method for, isolating, recovering or concentrating conducting polymer precursors derived from suitable petroleum streams.

Thus, the process is useful for producing a concentrate of these precursors. Certain process streams contain sources of monomers and other subunits or precursors useful for producing conducting polymers. However, such process streams often do not provide these in sufficient concentration or purity; and therefore, have not traditionally been viewed as desirable sources of such precursors. Applicants have discovered a process for recovering and concentrating monomers and other subunits suitable as precursors in the production of conducting polymers from process streams containing them.

These process streams are typically any hydrocarbon stream that contains non-basic heterocyclic organo-nitrogen compounds. Optionally, other organo-nitrogen species may also be present in the stream, but their presence is not required. These non-basic organo-nitrogen containing compounds are contained in petroleum streams or fractions having a boiling point of from at least 450° F. to 1050° F. (232–566° C.). Preferably, these streams or fractions should be liquid at process conditions. By "conducting polymers" it is meant organic nitrogen-containing polymers from electropolymerization reactions. The terms "precursors", "subunits" and the like include monomers, dimers and larger subunits of such organo nitrogen containing compounds, e.g., pyrroles, indoles and carbazoles, falling within the above boiling point range of the hydrocarbon streams.

In another preferred embodiment the process provides for contacting a hydrocarbon stream containing such non-basic heterocyclic nitrogen compounds with an effective amount, 10–200% on a volume basis relative to the volume of petroleum feedstock, of a treating agent selected from monohydroxyl (monohydric) group alcohols such as methanol, ethanol and alcohols having a density at 25° C. of less than 0.90 g/cm$^3$. The treating agent should be liquid or liquefiable at process conditions.

The contacting is carried out at conditions effective to non-destructively remove the non-basic heterocyclic nitrogen compound from the stream. Typically, the temperatures are sufficient to maintain the feedstream in a liquid or fluid state and to enable the treating agent to be effectively distributed in the feedstream to be treated. Such temperatures may be determined by one skilled in the art but can range from 20° C. to 250° C. Pressures are suitably atmospheric pressure to 10,000 kPa but for economic reasons it can be more economical for the process to be carried at autogenous pressure. The treating agent is added in an amount sufficient to decrease and preferably recover all of the non-basic heterocyclic nitrogen-containing compounds from the stream to be treated. Since such streams vary in non-basic heterocyclic-nitrogen content the amount of treating agent may be adjusted accordingly. Any hydrocarbonaceous stream within the disclosed boiling point range and containing non-basic heterocyclic nitrogen species may be treated by the process disclosed herein, including kerosene, diesel, light gas oil, atmospheric gas oil, vacuum gas oil, light catalytic cracker oil and light catalytic cycle oil.

In another preferred embodiment an effective amount of acid, typically 1 to 10 milliequivalents of mineral acids, such as sulfuric, hydrochloric, phosphoric and phosphorous acid and mixtures thereof may be added to enhance the process. Organic acids such as acetic acid are not as effective as mineral acids in this case. This embodiment of the invention makes possible the removal of both non-basic heterocyclic nitrogen species such as carbazoles but also basic species such as anilines and quinolines both of which are useful to produce conducting polymers. The ratio of basic to non-basic heterocyclic species varies considerably across the range of petroleum streams and in some cases it might be desirable to first extract the non-basic heterocyclic species with unacidified solvent and then in a second extraction with acidified solvent to isolate the basic nitrogen species.

Following separation of the precursor rich extractant phase from the hydrocarbon stream, the heterocyclic nitrogen species can be recovered by means known to those in the art for example by distillation of the lower boiling point agent or by addition of an effective amount of water to the extract, which causes the heterocyclic nitrogen molecules to phase separate. This highly concentrated nitrogen-rich phase can be further purified by conventional means as required before being subjected to electrochemical polymerization.

Thus, the process provides a simple method for recovering or concentrating nitrogen compounds from certain hydrocarbon stream desirably without regard to their acidity or alkalinity. The process thus allows for the recovery of these compounds useful in the synthesis of conducting polymers, and provides a feedstream enriched in these components. Also, beneficially, the treated petroleum feedstream will have a decreased nitrogen content as a result.

The process may be demonstrated with reference to the following

EXAMPLE

Example 1

Nitrogen Removal

Fifty grams of a virgin diesel and fifty grams of a treating agent were shaken vigorously in a 250 ml separatory funnel for one minute at 25° C. The two phases were allowed to separate. The nitrogen content of the diesel phase was determined according to ASTM D-4629 using a gas chromatographic analysis using a nitrogen specific detector (Antek). The initial diesel had a nitrogen content of 87 wppm. After separate single extractions with methanol and ethanol, the amount of nitrogen remaining in the feed was 32 and 36 wppm respectively.

What is claimed is:

1. A method for isolating conducting polymer precursors consisting essentially of: contacting a non-basic heterocyclic nitrogen containing hydrocarbon stream having a boiling point of from 232° C. (450° F.) to 566° C.) 1050° F.) with an effective amount of from 10–200 vol % a treating agent selected from monohydroxyl alcohols having a density at 25° C. of less than 0.90 g/cm$^3$ and mixtures thereof, at conditions effective to maintain the reactants in a liquid phase to produce a first hydrocarbon stream enriched in non-basic heterocyclic nitrogen containing hydrocarbons and a second treated hydrocarbon stream having a decreased non-basic heterocyclic nitrogen content.

2. The method of claim 1 further comprising adding an effective amount of a mineral acid to the treating agent.

3. The method of claim 1 wherein the hydrocarbon stream is selected from kerosene, diesel, light gas oil, atmospheric gas oil, vacuum gas oil, light catalytic cracker oil and light catalytic cycle oil.

4. The method of claim 1 further comprising contacting the second, treated stream with an a solution containing a mixture of a treating agent selected from the group consisting of monohydroxyl alcohols having a density at 25° C. of less than 0.90 g/cm$^3$ and mixtures thereof and an effective amount of a mineral acid to produce a stream enriched in heterocyclic nitrogen containing hydrocarbons and a treated stream having a decreased heterocyclic nitrogen content.

5. The method of claim 2 wherein the effective amount of mineral acid is from 1–10 meq.

6. The method of claim 1 wherein the monohydroxyl alcohol is selected from the group consisting of methanol and ethanol and mixtures thereof.

7. The method of claim 6 wherein the effective amount of mineral acid is from 1–10 meq.

* * * * *